US007699721B2

(12) United States Patent
Godlove, II

(10) Patent No.: US 7,699,721 B2
(45) Date of Patent: Apr. 20, 2010

(54) GOLF TEE SETTER AND METHOD OF MANUFACTURE

(75) Inventor: J. Carlton Godlove, II, Wyomissing, PA (US)

(73) Assignee: TZ, Golf, LLC, Wyomissing, PA (US)

( * ) Notice: Subject to any disclaimer, the term of this patent is extended or adjusted under 35 U.S.C. 154(b) by 109 days.

(21) Appl. No.: 11/857,127

(22) Filed: Sep. 18, 2007

(65) Prior Publication Data

US 2008/0070723 A1 Mar. 20, 2008

Related U.S. Application Data

(60) Provisional application No. 60/851,826, filed on Sep. 18, 2006.

(51) Int. Cl.
*A63B 57/00* (2006.01)

(52) U.S. Cl. ..... 473/386

(58) Field of Classification Search ..... 473/386–403
See application file for complete search history.

(56) References Cited

U.S. PATENT DOCUMENTS

| | | | | | |
|---|---|---|---|---|---|
| 2,801,852 | A | * | 8/1957 | Hottle | 473/386 |
| 2,950,110 | A | * | 8/1960 | Slotta et al. | 473/386 |
| 3,540,727 | A | * | 11/1970 | Hoe, Jr. | 473/386 |
| 3,671,036 | A | * | 6/1972 | Rubino | 473/386 |
| 4,336,940 | A | * | 6/1982 | Sprague | 473/393 |
| D279,208 | S | * | 6/1985 | Schuster | D21/793 |
| 4,589,661 | A | | 5/1986 | Attig | |
| 4,660,837 | A | | 4/1987 | Bressie | |
| 4,896,883 | A | * | 1/1990 | Wagenknecht | 473/386 |
| 4,951,947 | A | | 8/1990 | Kopfle | |
| 4,982,510 | A | | 1/1991 | Musillo | |
| 4,989,868 | A | * | 2/1991 | Manko | 473/386 |
| 5,052,689 | A | | 10/1991 | Lettrich | |
| 5,085,431 | A | * | 2/1992 | McGuire | 473/386 |
| 5,242,161 | A | | 9/1993 | Wilkirson | |
| 5,370,388 | A | | 12/1994 | Wehner | |
| D362,480 | S | * | 9/1995 | Reaves | D21/793 |
| 5,634,862 | A | | 6/1997 | Gamache | |
| 5,643,113 | A | | 7/1997 | Rodgers | |
| 5,645,500 | A | | 7/1997 | Borden | |
| D386,992 | S | | 12/1997 | Burnett et al. | |
| 5,718,646 | A | | 2/1998 | Brewer | |
| 5,735,758 | A | | 4/1998 | Miketinac | |
| 5,885,174 | A | | 3/1999 | Barnes | |
| 5,890,976 | A | | 4/1999 | Anderson | |
| 5,913,737 | A | * | 6/1999 | Park | 473/386 |

(Continued)

FOREIGN PATENT DOCUMENTS

| | | |
|---|---|---|
| DE | 202006013631 | 11/2006 |
| WO | WO-03/097179 | 11/2003 |

*Primary Examiner*—Steven Wong
(74) *Attorney, Agent, or Firm*—RatnerPrestia

(57) ABSTRACT

A golf tee setting device includes a generally cylindrical body having a top portion, a bottom portion, and a passage extending between the top portion and the bottom portion. The passage is sized to allow a golf tee to pass therethrough. The body has at least one opening therein between the top portion and the bottom portion. The opening defines a surface such that a line extending through the passage traverses the surface at two locations. A kit having a plurality of the devices of different lengths is also provided. Additionally, a method of manufacturing the device is also provided.

21 Claims, 15 Drawing Sheets

U.S. PATENT DOCUMENTS

| | | | | |
|---|---|---|---|---|
| 6,273,833 | B1 | 8/2001 | Murphy | |
| 6,287,219 | B1 * | 9/2001 | Addington | 473/386 |
| 6,428,429 | B1 | 8/2002 | Lee | |
| 6,475,107 | B1 | 11/2002 | Sand | |
| 6,887,169 | B2 | 5/2005 | Whitehill et al. | |
| 6,932,722 | B2 | 8/2005 | Wood | |
| 6,949,033 | B1 * | 9/2005 | Mydland | 473/386 |
| 2002/0183138 | A1 | 12/2002 | Malcolm | |
| 2005/0049085 | A1 | 3/2005 | Cumisky et al. | |
| 2005/0130769 | A1 | 6/2005 | Olsen | |

* cited by examiner

GOLF TEE SETTER AND METHOD OF MANUFACTURE

CROSS-REFERENCE TO RELATED APPLICATION

The present application claims priority from U.S. Provisional Application Ser. No. 60/851,826, filed on Sep. 18, 2006, the entire disclosure of which is incorporated herein by reference.

FIELD OF THE INVENTION

The present invention is directed to a device for consistently setting a golf tee at a desired height above the ground independent of the golf tee length.

BACKGROUND OF THE INVENTION

A conventional golf tee is readily known and recognizable by a golfer of any skill and ability. Teeing a golf ball is understood to be inserting a conventional golf tee into the ground and placing a golf ball on top of the tee, typically in the cupped end of the tee. Typically, a golfer sets a tee and tees his ball by placing the golf ball in the palm of the hand and grasping the tee between the index and middle fingers such that the golf ball rests in the cupped end of the tee. The ball is grasped firmly such that the tee points out between the knuckles. The golfer then closes his hand around the ball and tee. Grasped in this manner, the tip of the tee is oriented perpendicular to the ground and the golfer forces the tee into the ground by applying pressure through the golf ball.

From a set of clubs, the golfer selects a desired club based on the conditions present at a particular tee. Golf clubs are designed with an impact surface having differing loft (the angle between a vertical plane and the clubface when the club is at rest). A typical set of clubs generally consists of 3 woods, 2 wedges, a putter, and 8 irons (3, 4, 5, 6, 7, 8, and 9 irons, plus a pitching wedge). The longest wood, the 1 wood, is typically referred to as the driver. It has a large club head and typically the longest shaft. The shorter woods (e.g., the 3, 5, and 7 woods) are most commonly used when the ball is not on a tee, but in the fairway. These woods generally have greater loft than the driver and a smaller club head.

Different manufacturers of golf clubs emphasize different features of their driver depending on their target audience. For example, some manufacturers emphasize the large size of their driver club head. The accompanying larger sweet spot allows a golfer to hit his ball further. Other manufacturers emphasize that their driver club head with its low center of gravity creates a flight trajectory of the golf ball which results in a greater driving distance. Still other manufacturers emphasize that the shape of their driver club head allows a golfer to drive the ball further.

A result of these different features of the driver is that, depending on the style of driver, a golfer may desire to tee the golf ball at different heights above the ground so that the driver club head impacts the golf ball at the driver sweet spot. Accordingly, tees are available in different lengths, ranging from 1⅜ inches to 4 inches. It is not always practical for a golfer to use the same tee length, and therefore, there is a need for a device that sets the golf tee at a consistent height above the ground independent of the tee length.

BRIEF SUMMARY OF THE INVENTION

Briefly, the present invention provides a golf tee setting device. The device comprises a generally cylindrical body having a top portion, a bottom portion, and a passage extending between the top portion and the bottom portion. The passage is sized to allow a golf tee to pass therethrough. The body has at least one opening therein between the top portion and the bottom portion. The opening defines a surface such that a line extending through the passage traverses the surface at two locations.

The present invention also provides a golf tee setting device. The device comprises a generally cylindrical body having a longitudinal axis extending therethrough and a passage extending along the longitudinal axis. The passage is sized to allow a golf tee to pass therethrough. The body has first and second concave openings generally diametrically spaced from each other and defined by a wall having a top portion and a bottom portion each obliquely sloping inwardly toward the longitudinal axis.

The present invention also provides a kit comprising a plurality of golf tee setting devices. Each of the devices has a unique length, a generally cylindrical body having a longitudinal axis extending therethrough, and a passage extending therethrough along the longitudinal axis. The passage is sized to allow a golf tee to pass therethrough. The body has first and second concave openings generally diametrically spaced from each other. Each of the first and second concave openings are defined by a wall having a top portion and a bottom portion each obliquely sloping inwardly toward the longitudinal axis.

Additionally, the present invention also provides a method of manufacturing a golf tee setting device. The method comprises the steps of forming a generally cylindrical body having a longitudinal axis extending therethrough; and forming first and second concave openings in the body generally diametrically spaced from each other, wherein each of the first and second concave openings are defined by a wall having a top portion and a bottom portion each obliquely sloping inwardly toward the longitudinal axis.

Also, the present invention provides a golf tee setting device comprising a generally cylindrical body having a top portion, a bottom portion, and a pair of generally diametrically spaced throats connecting the top portion and the bottom portion. The throats define first and second openings generally diametrically spaced from each other between the top portion and the bottom portion. An inside surface and an outside surface of the bottom portion define a bottom portion thickness. An inside surface and an outside surface of each of the throats defines a throat thickness, such that the bottom portion thickness is the same as the throat thickness.

DETAILED DESCRIPTION OF THE INVENTION

This invention relates to a device and its method of manufacture, packaged individually and in a kit of progressive heights, which provides a method to repeatedly tee a golf ball at known, precise heights in a manner that mimics the conventional way in which a golfer customarily tees a golf ball.

According to an exemplary embodiment, the use of the invention is simple and subtle and requires no adjustments prior to or during use, thus removing any barriers to its adoption by users due to complexities or self-consciousness in use. The device is small and unobtrusive, easily carried without notice in the pocket, and the teeing motion and process is natural to anyone who has teed a golf ball in the customary way, offering the experienced golfer a consistent teeing height every time. For beginning players, a consistent teeing height is particularly difficult to achieve, and the teeing process itself can be difficult as well, particularly when inserting a tee into harder ground. According to an embodiment, the present invention eases the mechanics of the teeing process for the beginner by providing support to the tee during its insertion into the ground while producing a consistent teeing height.

Figure 7:
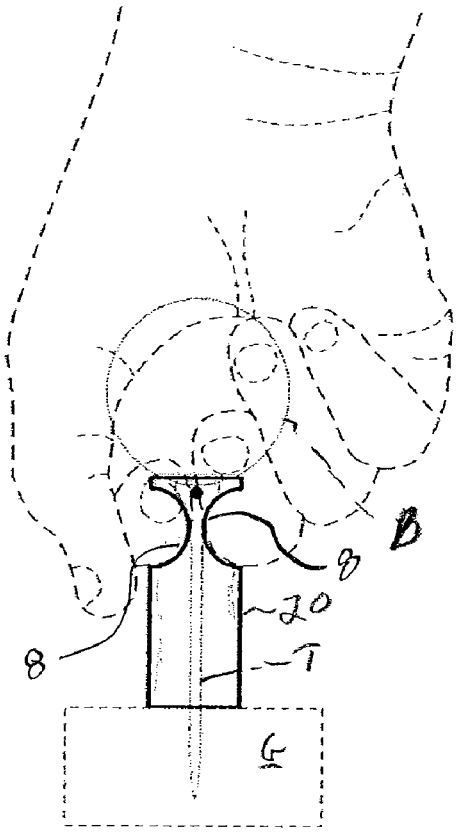
FIG. 7 is a front view of the device shown in FIG. 1 in use at the point of completed insertion of the tee into the ground.
Figure 8:
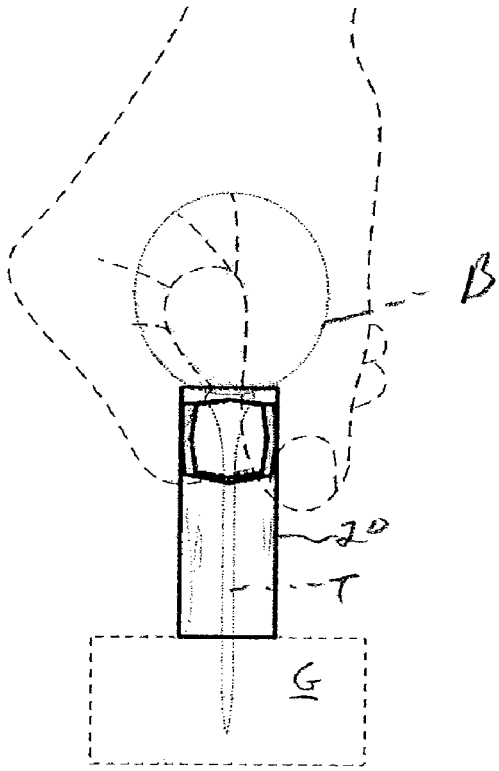
FIG. 8 is a side view of the device in use shown in FIG. 7.

A device 20 according to an exemplary embodiment of the present invention, shown in FIGS. 1-6, is used, in combination with a golf tee "T" and a golf ball "B", shown in FIGS. 7 and 8, to tee the golf ball "B" at a desired height above ground "G". As shown in FIGS. 7 and 8, device 20 also assists in inserting tee "T" into ground "G" at an angle generally perpendicular with ground "G".

Figure 1:
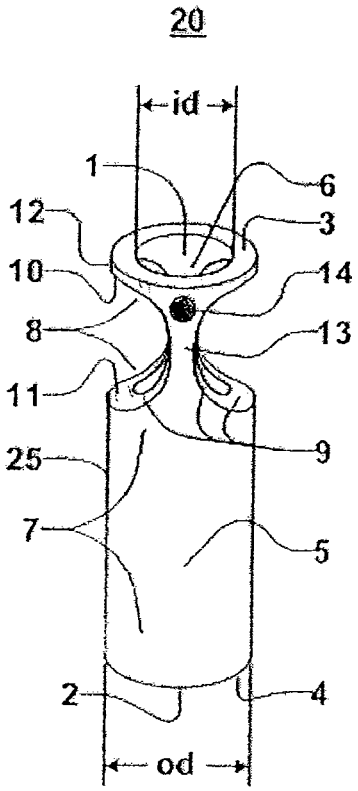
FIG. 1 is a perspective view of the device according to an embodiment of the present invention.
Figure 2:
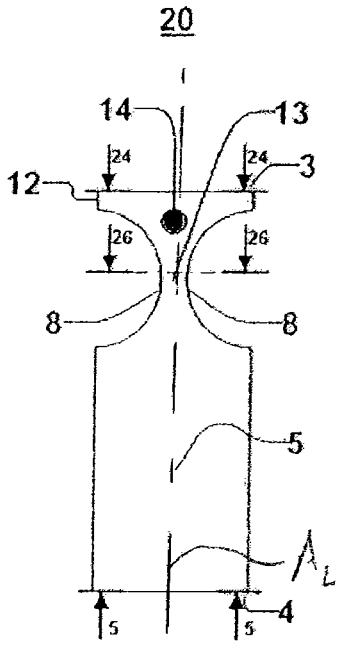
FIG. 2 is a front view of the device shown in FIG. 1.
Figure 3:
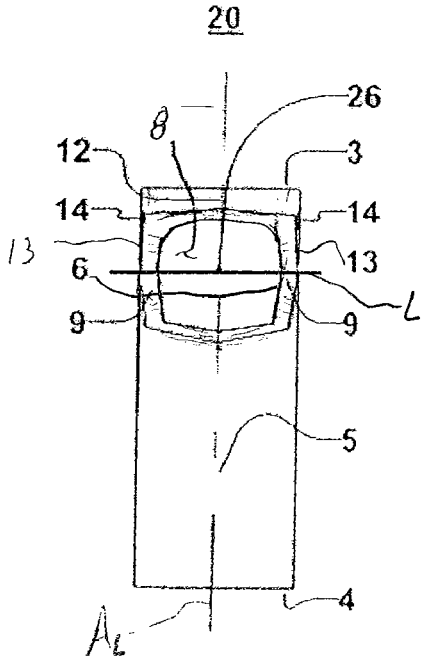
FIG. 3 is a side view of the device shown in FIG. 1.

As shown in FIGS. 1-3, device 20 is generally tubular in shape with no moving parts. According to an exemplary embodiment, device 20 ranges in fixed length from about 1" to about 3½" in, for example, ½", ¼", ⅛" or 1/16" increments, to accommodate various golf club head sizes, golfer preferences, and course conditions.

Device 20 comprises a hollow cylindrical body 7 having a center longitudinal axis $A_L$, a side wall 15 defined by an outside surface 5, an inside surface 6, and open ends 1, 2. Ends 1, 2 are disposed on opposing sides of body 7. According to another embodiment, body 7 may be other than a cylinder. For example, body 7 can be a hollow square or triangle. Body 7 may be any suitable shape so long as it defines an interior passage that accommodates the complete longitudinal passing of a conventional golf tee. Open end 1 includes a top ball contact surface 3 on which a golf ball is placed when using device 20 to set the height of a golf tee. Open end 2 includes a bottom contact surface 4 that engages the ground when setting the height of the golf tee.

In an exemplary embodiment, body 7, which is defined by wall 15, has a generally constant inside diameter. Alternative embodiments of body 7 may have inside diameters that are not constant along the length of device 20. Body 7 has a length equal to the desired distance a golf ball set upon the tee is positioned above the ground. Thickness of wall 15, measured from inside surface 6 of body 7 to outside surface 5 of body 7, and is in the range of between about 2 and about 10 mm, preferably between about 2 and about 5 mm, most preferably, about 3 mm. Body 7 inside diameter (id) is shown in this particular embodiment to be a constant 15 mm, but may range along the length of body 7 from about 5 mm to about 30 mm. Top tee insertion hole 1 and bottom tee insertion hole 2 may have diameters of 15 mm. The outside diameter (od) of device 20 is in the range of about 10 to about 50 mm, preferably between about 15 and about 25 mm, most preferably about 21 mm.

Proximate to open end 1 of body 7, body 7 defines two through-holes 8 diametrically opposed and perpendicular to longitudinal axis $A_L$ of body 7 along centerline 26. Through-holes 8 are of a size and configuration that when a golfer grasps device 20 as shown in FIGS. 7 and 8, the inside of the golfer's fingers placed on opposite sides of through-holes 8 extend sufficiently close to longitudinal axis $A_L$ of body 7 to comfortably hold a tee. According to an embodiment, the design and the method of manufacture of device 20 results in a device having a geometry such that, when the device is in use, such use mimics the customary manner in which a golf ball is normally teed. Through-holes 8 are centered approximately 11 mm from top ball contact surface 3. Through-holes 8 form two generally hour-glass shaped throats 13 approximately between about 1 and about 5 mm, preferably about 3 mm, in thickness at horizontal centerline 26 of through-holes 8 as shown in FIG. 2. Horizontal centerline 26 is substantially perpendicular to the longitudinal axis $A_L$ of body 7.

Throats 13 define through-holes 8 and separate body 7 into a top portion proximate to top tee insertion hole 1 and a bottom portion proximate to bottom tee insertion hole 2. As shown in FIGS. 1-3*a*, the bottom portion has a longer axial length than the top portion. A distance between inside surface 6 of body 7 and outside surface 5 of body 7 defines a thickness. This thickness is the same at the bottom portion of body 7 proximate to tee insertion hole 2 and at throats 13 to provide structural support for throats 13.

Figure 3A:
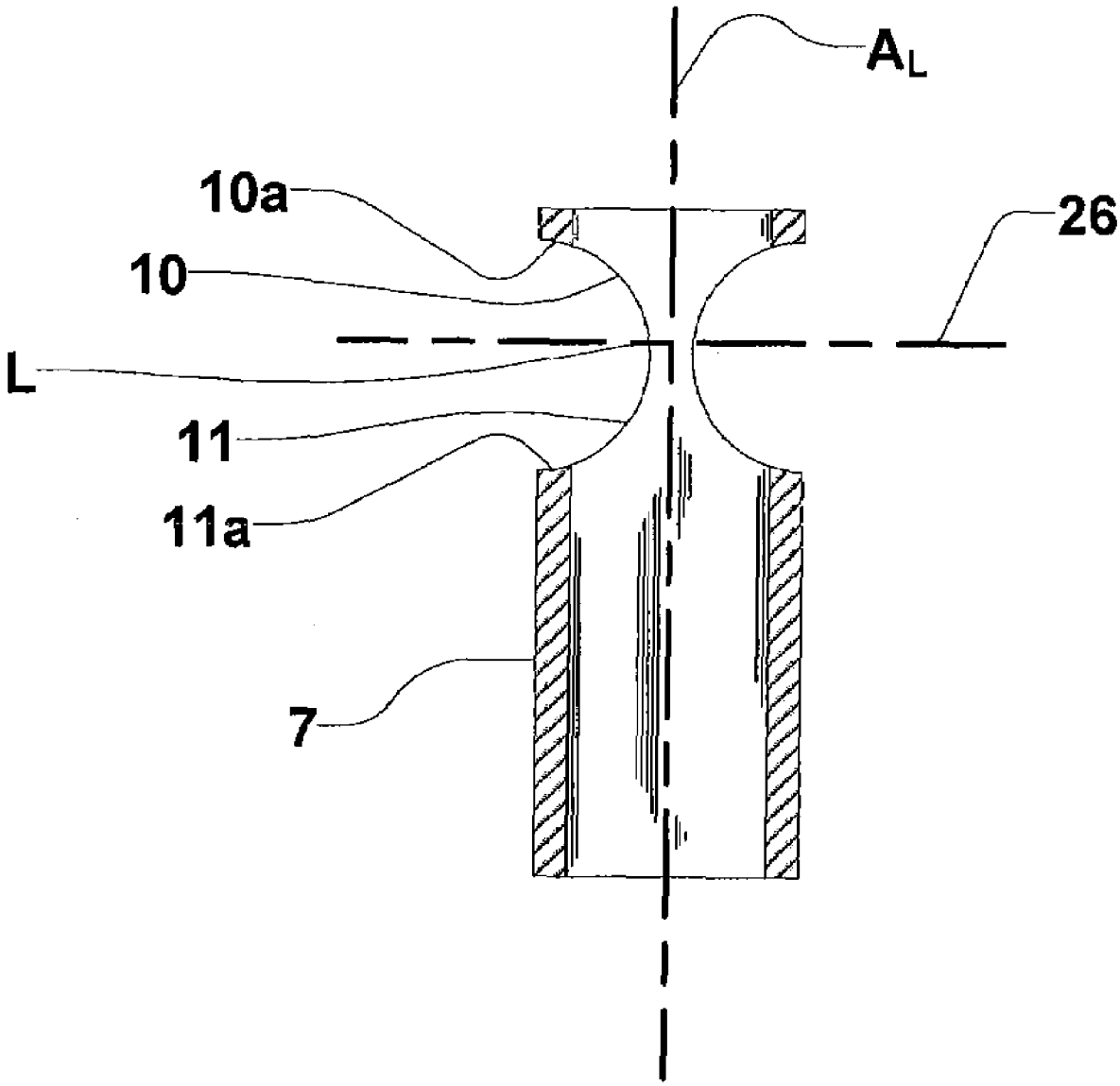
FIG. 3*a* is a longitudinal sectional view of the device shown in FIG. 1.
Figure 4:
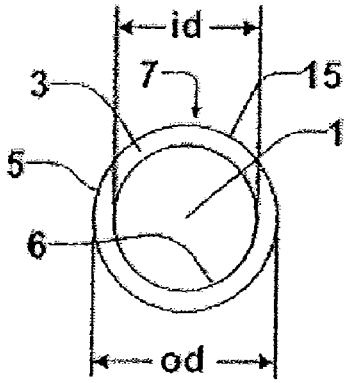
FIG. 4 is a top view of the device shown in FIG. 1.
Figure 5:
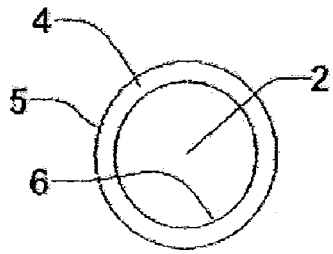
FIG. 5 is a bottom view of the device shown in FIG. 1.
Figure 6:
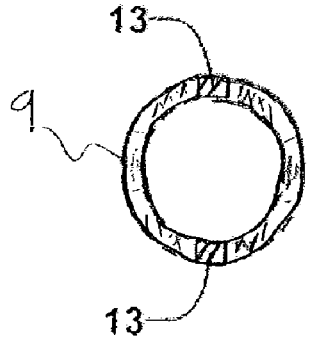
FIG. 6 is a sectional view cut along horizontal centerline 26 of through-holes 8 shown in FIG. 2.

Through-holes 8 are defined by a gripping surface 9 in wall 15 having a top flat, outwardly facing concave gripping surface 10 and a bottom flat, outwardly facing concave gripping surface 11. Gripping surfaces 10, 11 meet in a plane containing centerline 26 and extending perpendicularly from a plane of the paper containing FIGS. 2 and 3. As shown in FIG. 3*a*, a top portion 10*a* of gripping surface 10 and a bottom portion 11*a* of gripping surface 11 each obliquely slopes inward toward longitudinal axis $A_L$. Such oblique inward sloping portions 10*a*, 11*a* provide a comfortable fit between gripping surface 9 and the golfer's fingers when device 20 is in use. The two gripping through-holes 8 form finger slots to simultaneously grasp tee "T" as shown in FIGS. 7 and 8 and hold device 20. As shown in FIG. 2, through-holes 8 have a larger height than depth toward longitudinal axis $A_L$.

Referring back to FIGS. 1-3, the top of body 7 has a gripping lip 12 approximately 1-5 mm, preferably 3 mm, in thickness defined by the distance between top ball contact surface 3 and the plane of top center gripping concavity surface 10. Gripping lip 12 is connected to a remainder of body 7 by throats 13.

A feature of each through-hole 8 is that each through-hole 8 defines gripping surface 9 such that a line extending through the interior passage traverses gripping surface 9 at two locations. This feature is evidenced in FIG. 3, which shows a line "L" drawn perpendicular to, but not coplanar with, longitudinal axis $A_L$ traversing gripping surface 9 of each throat 13. In FIG. 3A, line "L" extends perpendicularly from a plane of the paper.

The contour of gripping surface 9 as described above facilitates the gripping of device 20 as shown in FIGS. 7 and 8. The user's fingers are able to extend along through-holes 8, generally parallel to line "L" (not shown in FIGS. 7 and 8).

Figure 9A:
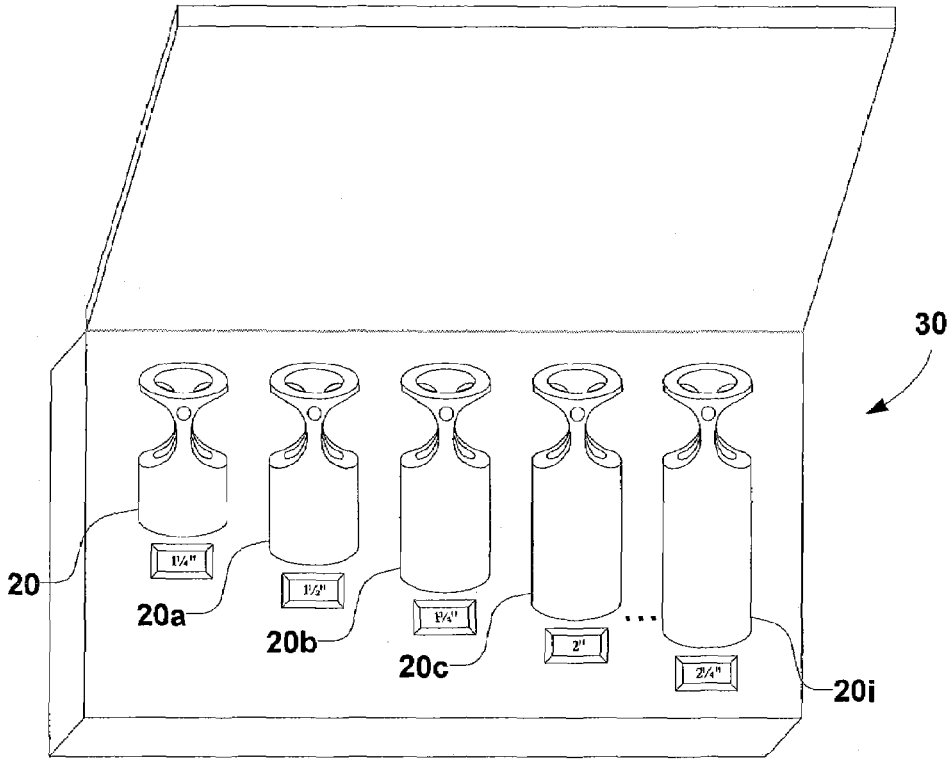
FIG. 9*a* is a perspective view of a kit including multiple embodiments of the device shown in FIG. 1.
Figure 9B:
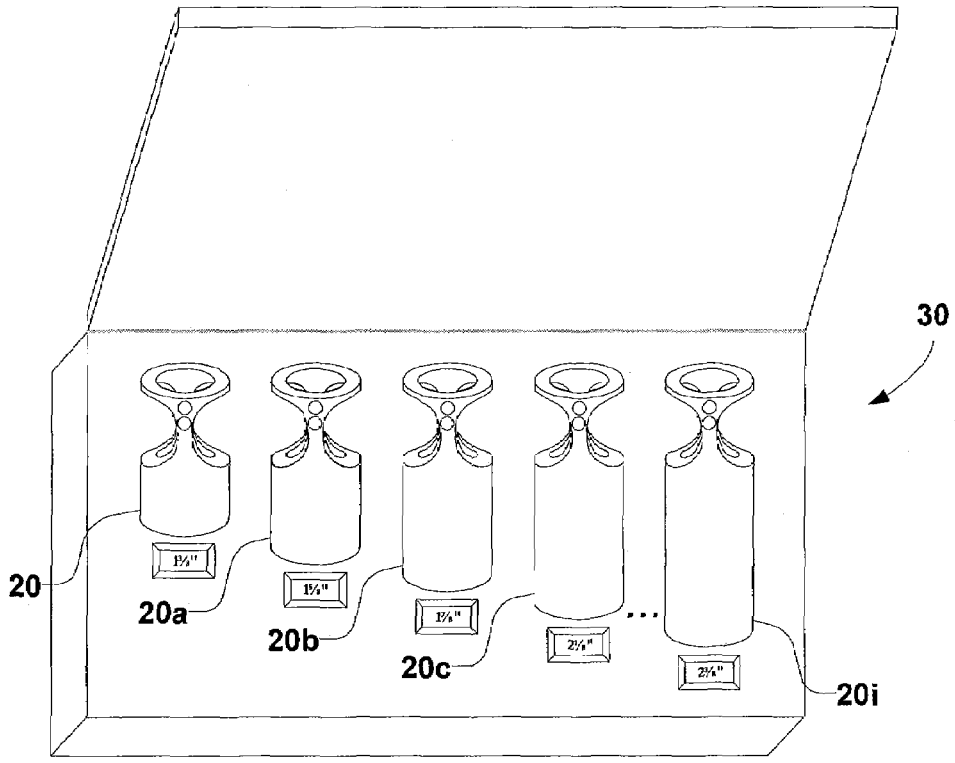
FIG. 9*b* is a perspective view of another embodiment of a kit including multiple embodiments of the device shown in FIG. 1.

According to yet a further embodiment shown in FIGS. 9*a*, 9*b*, the present invention includes a plurality of devices 20-20*i* packaged in a kit 30. Kit 30 includes an assortment of devices 20-20*i* having progressive body lengths to accommodate various golf club head sizes, individual golfer swing styles and course conditions, and whose method of manufacture creates a device geometry that allows its user to mimic the customary manner in which a golf ball is normally teed. Each device has an indicator directly on the device to indicate the teeing height achieved by that device. In these embodiments, the color and number of dots near the top of the device indicate the teeing height of each device. Alternate embodiments of this kit could package these progressively sized devices in or around tubes, in pouches, strung together by means of a chain, string or similar means, or packaged in conjunction with other devices, including golf tees. Other embodiments of this kit could also include sizes from 1 inch or smaller to 3½ inches or larger in alternate increments, including ⅛ inch increments. While kits 30 shown in FIGS. 9*a*, 9*b* each show five (5) devices 20-20*i*, those skilled in the art will recognize that kits 30 may include more or less than five (5) devices 20-20*i*.

Device 20 may include height indicia 14 to identify the body length, and thus the resulting height the ball will be set above the ground. Such height indicia 14 may include, but is not limited to, a visible height identification marker and/or a tactile height identification marker. Such indicia 14 allows a golfer to keep a single device 20 and/or multiple devices out of sight, for example in a pants pocket, and when reaching for device 20, be able to identify which device 20-20*i* from kit 30 he has grabbed.

An exemplary visible height identification indicia 14 includes a color-coded system where the entire device 20 or a portion of device 20 is marked with a number, letter, or color which corresponds to the particular height the ball will be placed above the ground using that device. An exemplary tactile height identification system includes a system where device 20 is marked with indentations, detents, surface patterns, or the like which corresponds to the particular height the ball will be placed above the ground using that device. According to an exemplary embodiment, indicia 14 may include both a visible and tactile height identification system using colored recesses as shown in FIG. 1. This exemplary embodiment has a recess near the top of device 20, which recess is slightly depressed into the side surface of the body wall 15, and whose color would indicate the length of body 7, and resulting teeing height achieved through its use. Alternate embodiments utilize multiple dots in addition to color differences to indicate the device length and teeing height. Further alternate embodiments could also position the recess in other locations on body 7, or use other geometrical shapes to indicate the height, including a depression or depressions with or without color coding in or on the top or bottom surfaces of device 20. Still further alternate embodiments could also use color, patterns or tactile features over part of the device or over the entire device to indicate device length and teeing height. Additionally, other indicia, such as company logos, symbols, etc. may be imprinted or embossed on the exterior of body 7, such as for advertising or other purposes.

Device 20 is constructed from a material that holds its shape. Device 20 is sturdy, but can also be pliable, as long as device 20 provides sufficient structural integrity to support the pressures exerted on it during its use. According to one embodiment, device 20 is moisture repellant or resistant, such that it resists corrosion from exposure to the elements. Device 20 is constructed of a material such as wood, metal, plastic, combinations and/or mixtures thereof. An exemplary material of device 20 is polyvinyl chloride, commonly referred to as PVC. Device 20 may be of unibody design, i.e., it is formed from a single piece of material with no moving parts.

Alternatively, device 20 may be formed from separate components. An exemplary embodiment of device 20 formed from separate or multiple components is an embodiment where the length of device body 7 is adjustable; thereby allowing a golfer to select the desired height that the golf ball is to be teed above the ground. The length of body 7 may be made adjustable through telescope expansion of body 7, two or more body components in an adjustable, e.g. threaded, connection, or two or more body components in a frictional fit connection.

Referring now to FIG. 7 and 8, device 20 is shown in use. Having selected a desired one of devices 20-20*i* from kit 30, using indicia 14 on each of devices 20-20*i* to determine which device 20 to select, golfer longitudinally inserts a tee "T" from either the top tee insertion hole 1 or the bottom tee insertion hole 2 orienting the top, cupped end of tee "T" to top ball contact surface 3 with the bottom, pointed end of tee "T" protruding from bottom tee insertion hole 2.

Then the golfer grasps tee "T" through gripping concavities 8 as would normally be done between the middle phalanx of the index and middle fingers while securing golf ball "B" between the palm of the same hand and top ball contact surface 3 of device 20 and the top cupped end of tee "T" as if device 20 were absent. The obliquely sloping top portion 10*a* of gripping surface 10 and bottom portion 11*a* of gripping surface 11 provide a comfortable grip of device 20 within the golfer's hand as the golfer grips device 20.

The golfer then leans over and drives tee "T" into ground "G" using ball "B" to apply the force necessary to drive tee "T" into ground "G" as is customary and as if device 20 were absent, device 20 limiting the penetration of tee "T" into ground "G", providing a consistent teeing height. While retaining device 20 between the first and middle fingers, ball "B" and device 20 are lifted simultaneously off tee "T"; then, with a subtle outward roll of the hand, ball "B" is replaced on top of tee "T" and oriented to the golfer's liking, as is customary, all the while retaining device 20 comfortably and unobtrusively in the same position between the index and middle finger. Finally, the golfer stands upright, effortlessly and naturally returning device 20 to a pant pocket in the process.

While the above-described method is an exemplary method that can be used to insert a golf tee using device 20, those skilled in the art will recognize that device 20 may be used to insert a golf tee into the ground using other methods that are comfortable to the user.

Figure 10A:
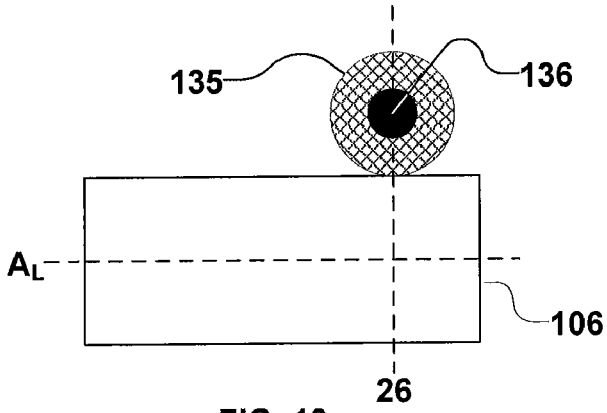
FIGS. 10*a*-10*e* is a sequence of views perpendicular to a longitudinal axis illustrating an exemplary method of manufacturing the device shown in FIG. 1.
Figure 10B:
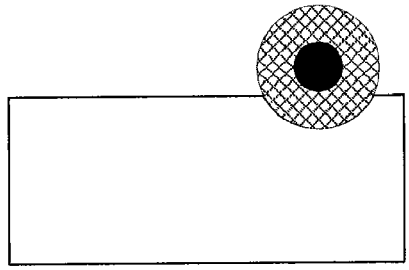
Figure 10C:
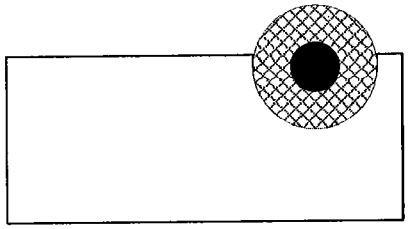
Figure 10D:
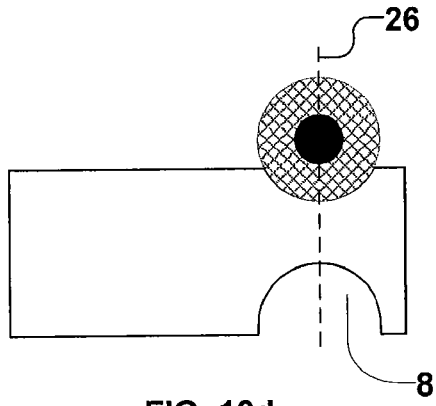
Figure 10E:
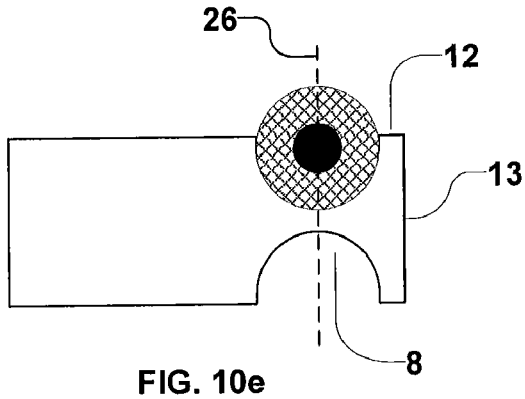

FIGS. 10*a*-10*e* is a sequence of views perpendicular to a longitudinal axis of the device, illustrating an exemplary method of manufacturing device 20. To make through-holes 8, as shown in FIG. 10*a*, a router 135 having a longitudinal axis 136 is placed perpendicular to longitudinal axis $A_L$ of preform 106 of the device. As router 135 is moved closer to center longitudinal axis $A_L$, through-holes 8 are formed having horizontal centerline 26. See, for example, FIGS. 10*b* and 10*c*. After first through-hole 8 is formed, second through-hole 8 is formed such that the second through-hole axis is coincident with the axis of first through-hole 8, as illustrated in FIGS. 10*d* and 10*e*.

Manufacturing through-holes 8 with this exemplary process results in a geometry of through-holes 8 that make it possible for a golfer to use device 20 in the manner described. As discussed above, the series of illustrations in FIG. 10 show that each concavity can be made by routing the side of device 20 with a cylindrical cutting tool 135, with the longitudinal axis of the cutting tool 135 being perpendicular to but not intersecting longitudinal axis $A_L$ of device 20. An exemplary cutting tool 135 has a ⅝" diameter.

Figure 11A:
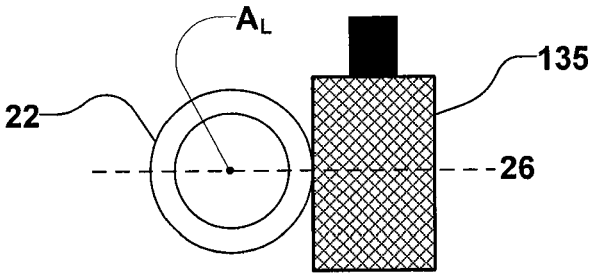
FIGS. 11*a*-11*e* is a sequence of views along a longitudinal axis in the process shown in FIGS. 10*a*-10*e;*
Figure 11B:
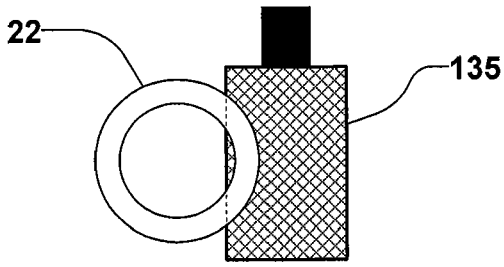
Figure 11C:
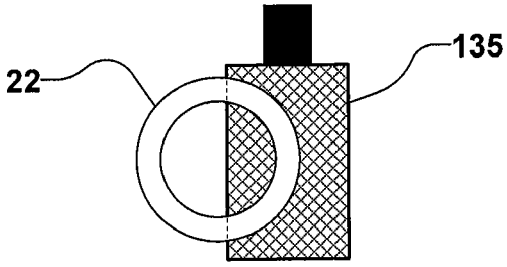
Figure 11D:
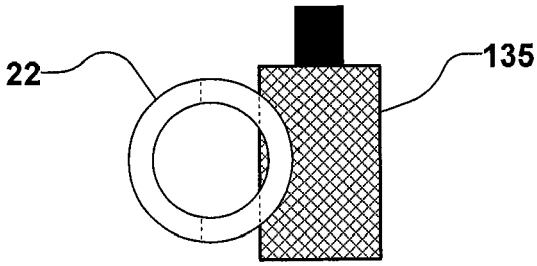
Figure 11E:
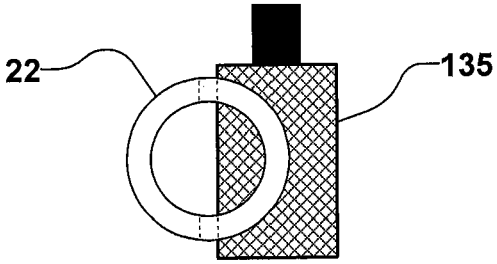

FIGS. 11*a*-11*e* illustrate a sequence of views along longitudinal axis $A_L$ showing the formation of through-holes 8 in a preform 22 of the device of FIG. 1 in the process shown in FIG. 10. FIG. 11*a* illustrates a first sequential view corresponding to the first sequential view of FIG. 10*a*. Similarly, sequential views 11*b*, 11*c*, 11*d*, and 11*e* correspond to sequential views 10*b*, 10*c*, 10*d*, and 10*e*.

Figure 12A:
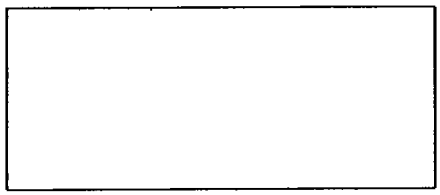
FIGS. 12*a*-12*e* is a sequence of views illustrating the device form alone for each view shown in FIGS. 10*a*-10*e;*
Figure 12B:
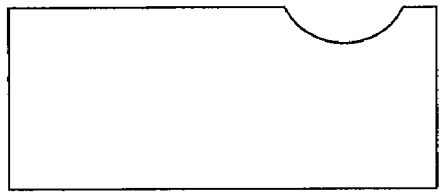
Figure 12C:
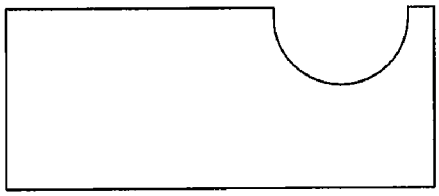
Figure 12D:
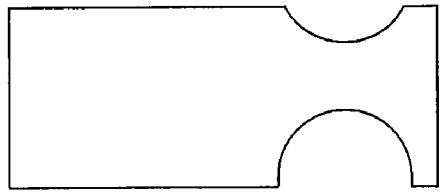
Figure 12E:
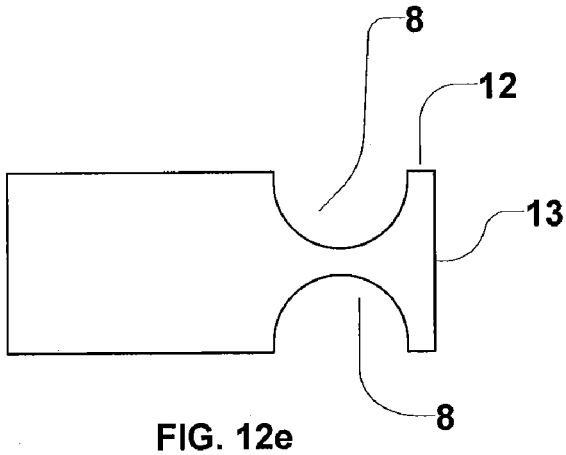
Figure 13A:
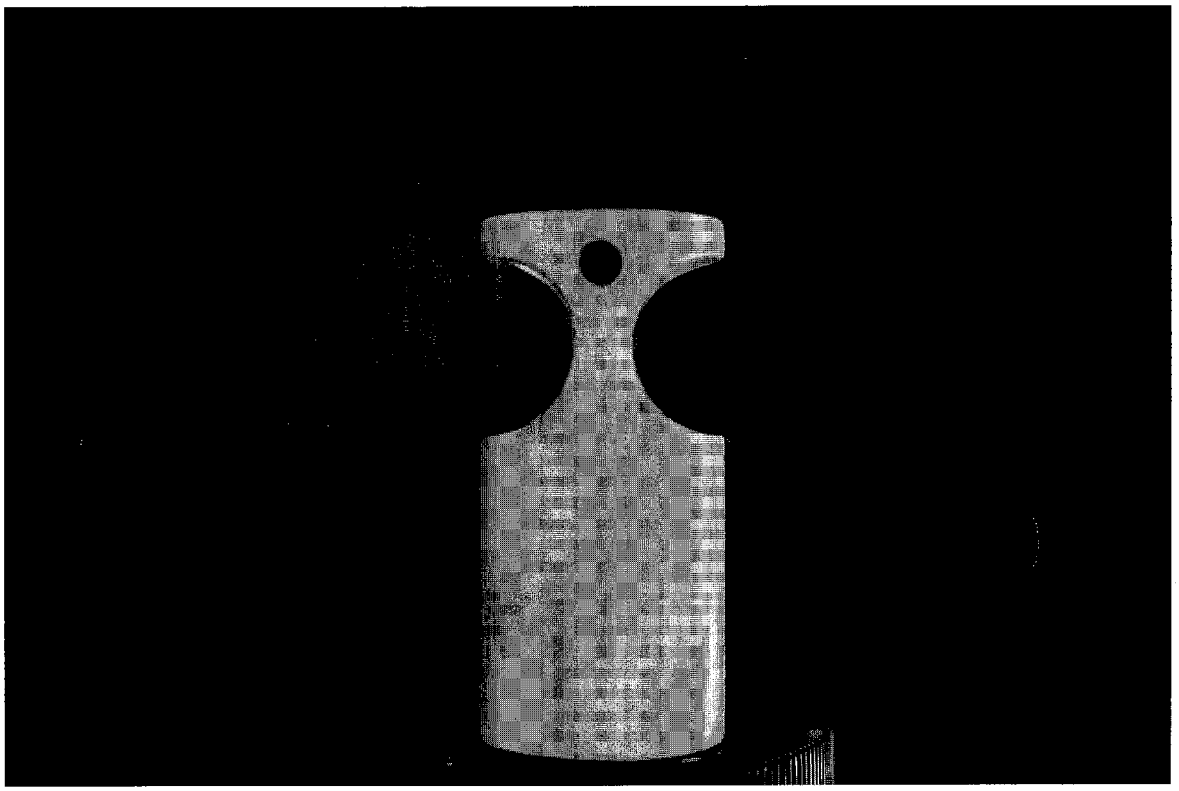
FIGS. 13*a*-13*g* illustrate photos of several different views of an exemplary embodiment of the present invention manufactured according to the method of FIGS. 10*a*-11*e*.
Figure 13B:
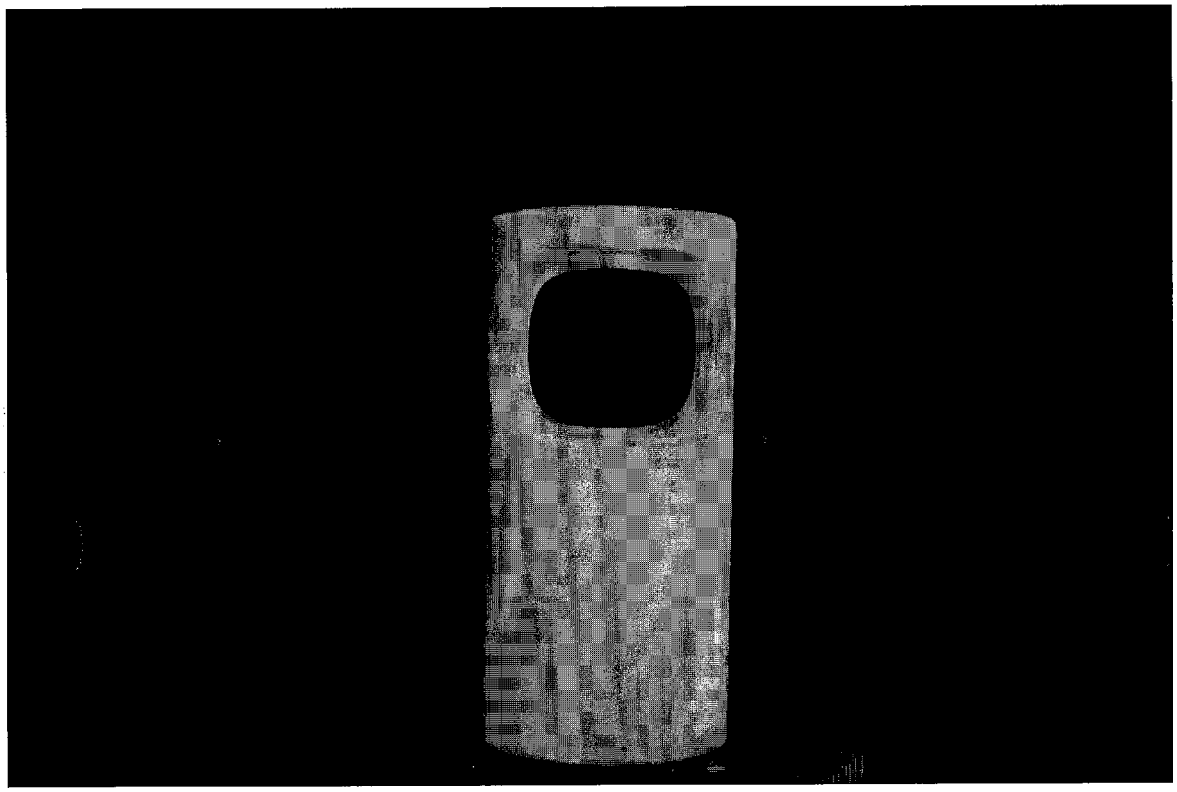
Figure 13C:
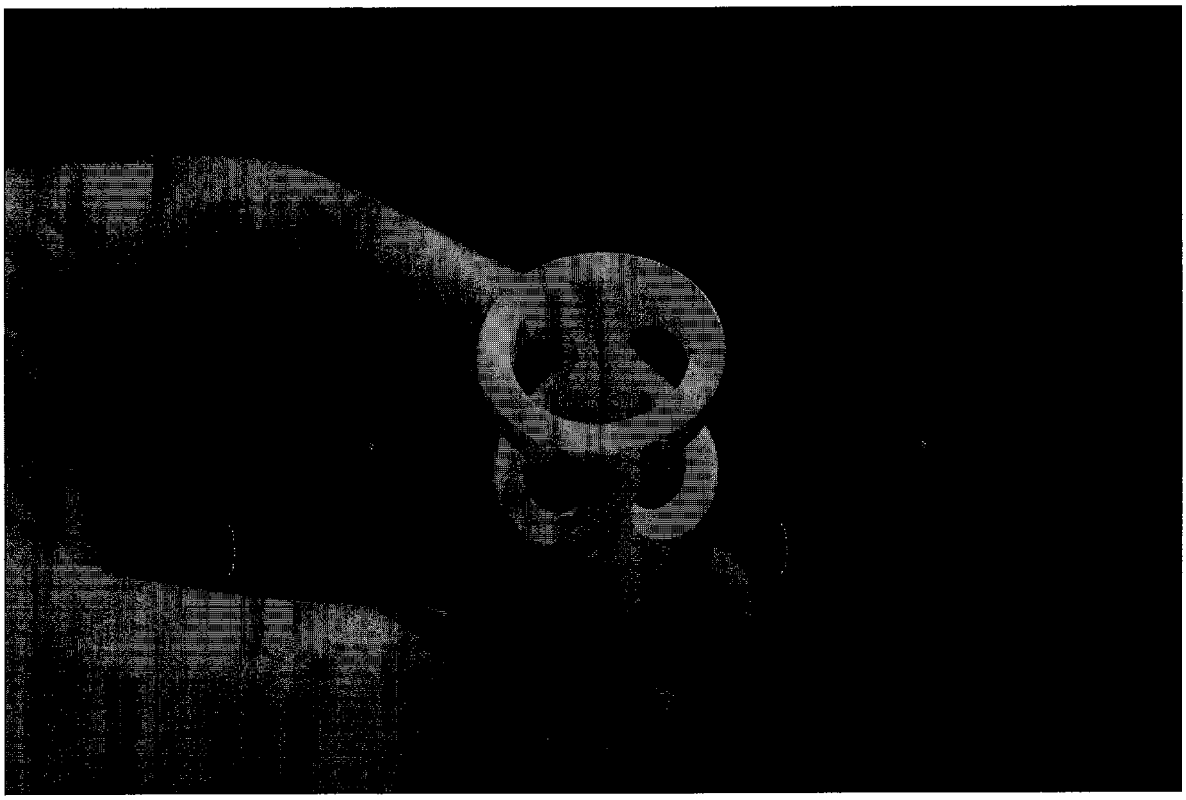
Figure 13D:
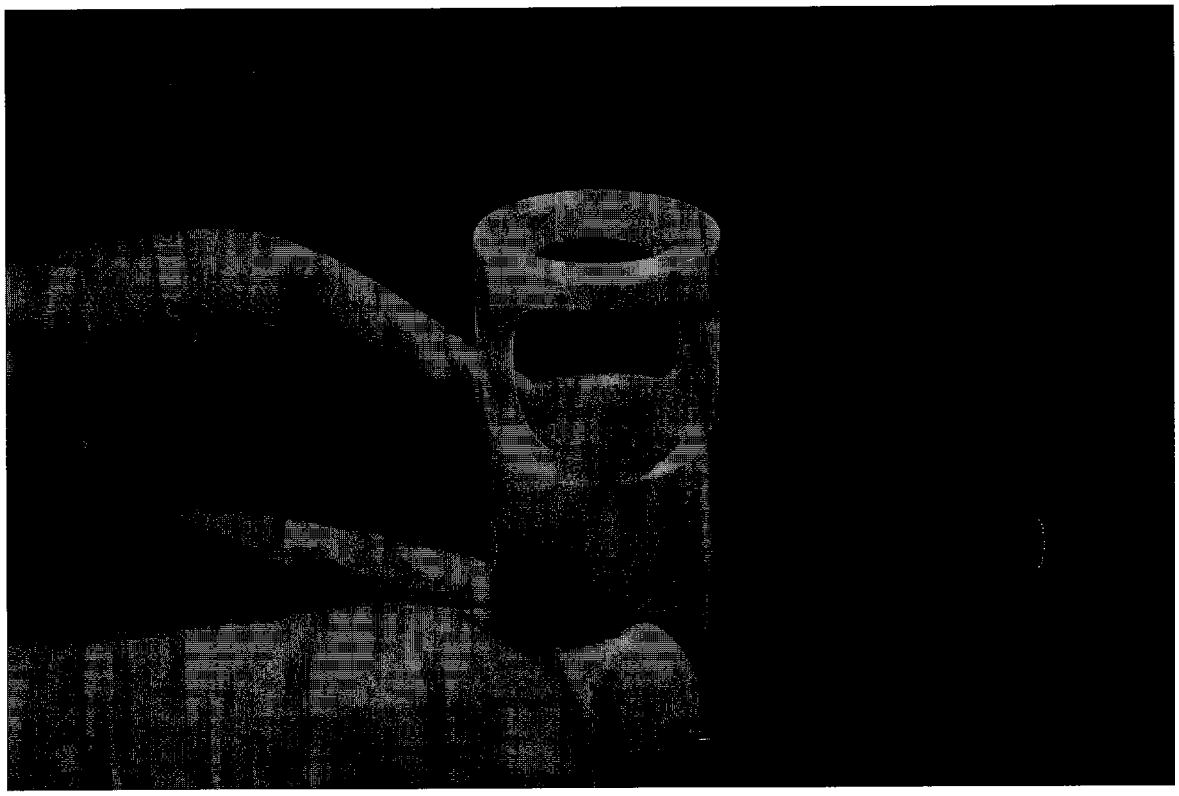
Figure 13E:
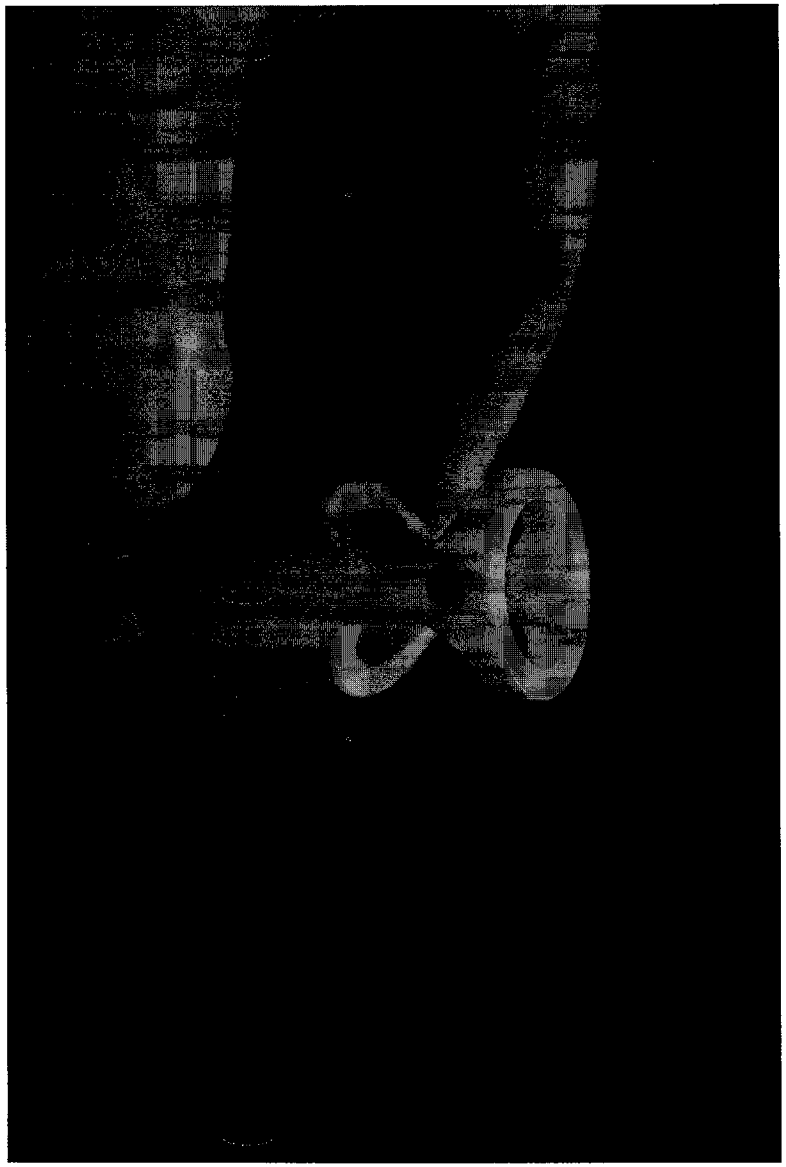
Figure 13F:
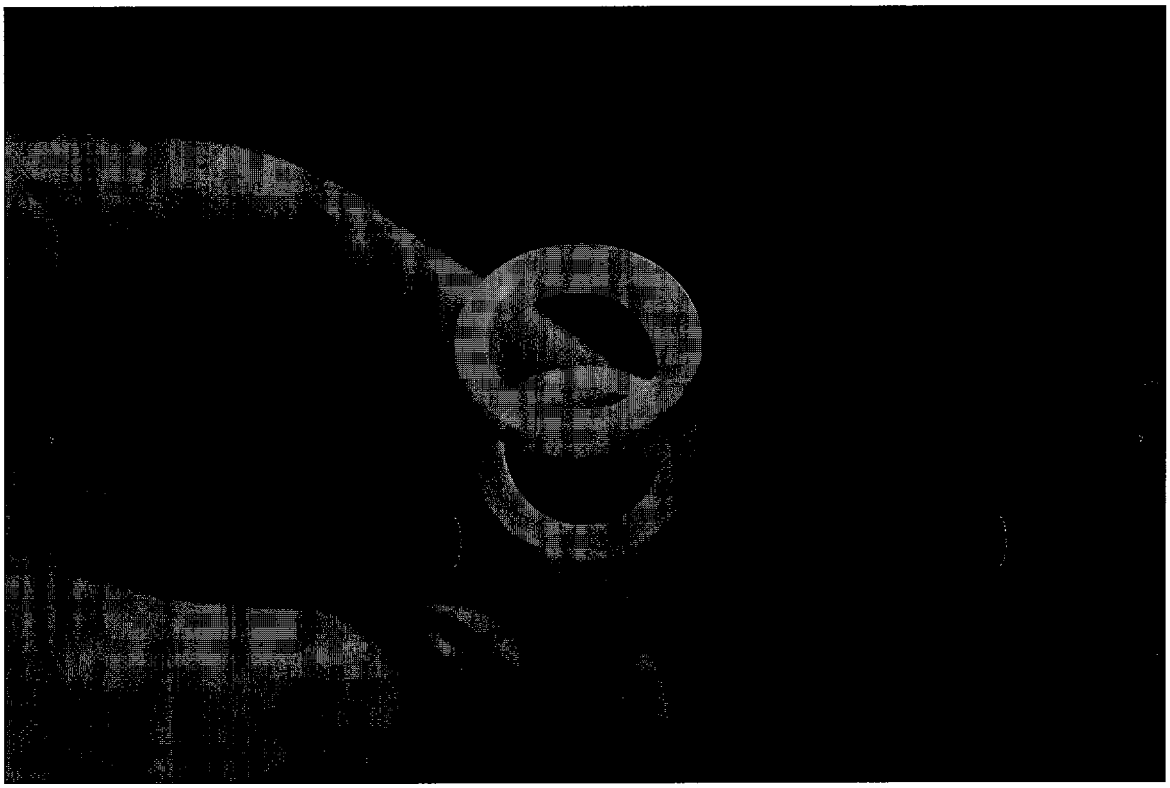
Figure 13G:
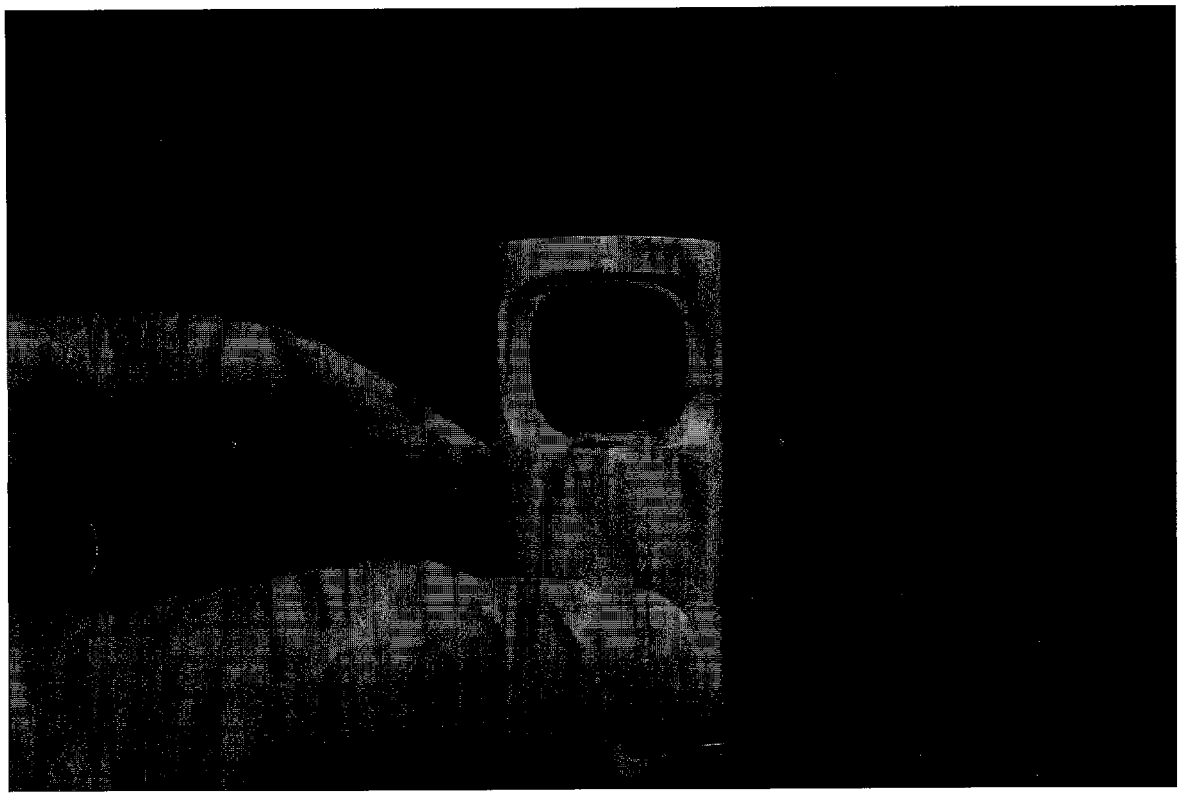

FIGS. 12*a*-12*e* illustrate a sequences of side views showing the formation of through-holes in a preform for the device of FIG. 1 according to an exemplary method of manufacturing the device shown in FIGS. 10*a*-10*e*, but not showing router 135. FIG. 12*a* corresponds to the first sequential view 10*a*. Similarly, sequential views 12*b*, 12*c*, 12*d*, and 12*e* correspond to sequential views 10*b*2, 10*c*, 10*d*, and 10*e*.

The feature of the through-holes 8 being defined by gripping surface 9 such that line "L" extending across the interior passage traverses gripping surface 9 at two locations is a result of the manufacturing process described above. Photographs of a device 20 manufactured by the method described above are shown in FIGS. 13*a*-13*g*.

The method of manufacture described above and shown in FIGS. 10*a*-12*e* disclose a device 20 having top portion 10*a* of gripping surface 10 and bottom portion 11*a* of gripping surface 11 that each lie in planes generally perpendicular to longitudinal axis $A_L$. In an exemplary embodiment of the present invention, after routing through-holes 8, all surfaces of device 20 may be sanded or otherwise smoothed, resulting in top portion 10*a* of gripping surface 10 and bottom portion 11*a* of gripping surface 11 extending obliquely to longitudinal axis $A_L$. Those skilled in the art, however, will recognize that the smoothing step need not be performed, or, alternatively, other methods of manufacture may be used that result in top portion 10*a* of gripping surface 10 and bottom portion 11*a* of gripping surface 11 each lying in planes generally perpendicular to longitudinal axis $A_L$.

While the method of manufacture discussed above and illustrated in FIGS. 10*a*-12E discloses an exemplary method of manufacturing the present invention, those skilled in the art will recognize that other methods, such as, for example, injection molding, may be used instead. A method such as injection molding may perform all of the manufacturing steps recited above generally simultaneously. Although not shown in FIGS. 10*a*-12*e*, identifying indicia may be formed on device 20 before, during, or after manufacture.

In an alternative embodiment, not shown, a device may include only a single through-hole 8. Operation of this alternative embodiment is similar to the operation of device 20 as discussed above, but with golf tee "T" being pressed against inside surface 6 of body 7 by a finger pressed along the single through-hole.

While exemplary embodiments of the invention have been shown and described herein, it will be understood that such embodiments are provided by way of example only. Numerous variations, changes and substitutions will occur to those skilled in the art without departing from the spirit of the invention.

What is claimed is:

1. A golf tee setting device comprising:

a generally cylindrical body having a longitudinal axis, a top portion, a bottom portion, and a passage extending between the top portion and the bottom portion, the passage sized to allow a golf tee to pass therethrough, the body having at least one opening therein between the top portion and the bottom portion, the opening comprising a substantially cylindrical cutout having a longitudinal axis substantially perpendicular to but not intersecting with the longitudinal axis of the cylindrical body, the cutout being defined by flat, outwardly facing concave walls and the bottom portion having a longer axial length than the top portion.

2. The golf tee setting device according to claim 1, wherein the at least one opening comprises two openings diametrically opposed from each other.

3. A golf tee setting device comprising:

a generally cylindrical body having a longitudinal axis extending therethrough and a passage extending along the longitudinal axis, the passage being sized to allow a golf tee to pass therethrough, the body having first and second concave openings generally diametrically spaced from each other proximate to one end of the cylindrical body, each opening comprising a substantially cylindrical cutout having a longitudinal axis substantially perpendicular to but not intersecting with the longitudinal axis of the cylindrical body.

4. The golf tee setting device according to claim 3, wherein the first and second concave openings have a coincident opening axis extending perpendicular to the longitudinal axis.

5. The golf tee setting device according to claim 3, wherein the body further comprises a gripping lip disposed proximate to a top portion of the body and a pair of throats connecting the gripping lip with the remainder of the body on either side of the first and second openings.

6. The golf tee setting device according to claim 3, wherein the body has a length sufficient to insert a golf tee at least partially disposed therein into the ground such that the golf tee extends from the ground a desired distance.

7. The golf tee setting device according to claim 3, further comprising indicia disposed on the body to indicate a length of the body.

8. A kit comprising a plurality of golf tee setting devices, each of the devices having a unique length, a generally cylindrical body having a longitudinal axis extending therethrough, and a passage extending therethrough along the longitudinal axis, the passage being sized to allow a golf tee to pass therethrough, the body having first and second concave openings generally diametrically spaced from each other proximate to one end of the cylindrical body, each opening comprising a substantially cylindrical cutout having a longitudinal axis substantially perpendicular to but not intersecting with the longitudinal axis of the cylindrical body the cutout being defined by flat, outwardly facing concave walls.

9. The kit according to claim 8, wherein each device comprises identification indicia to identify the unique length of the device.

10. The kit according to claim 9, wherein the identification indicia comprises a visual indicator.

11. The kit according to claim 9, wherein the identification indicia comprises a tactile indicator.

12. A method of manufacturing a golf tee setting device comprising the steps of:

a. forming a generally cylindrical body having a longitudinal axis extending therethrough; and b. forming first and second concave openings in the body generally diametrically spaced from each other proximate to one end of the cylindrical body, each opening comprising a substantially cylindrical cutout having a longitudinal axis substantially perpendicular to but not intersecting with the longitudinal axis of the cylindrical body the cutout being defined by flat, outwardly facing concave walls.

13. The method according to claim 12, wherein steps a and b are performed generally simultaneously.

14. The method according to claim 12, wherein steps a and b are performed by injection molding.

15. The method according to claim 12, further comprising providing identification indicia on the body.

16. A golf tee setting device comprising:

a generally cylindrical body having a longitudinal axis, a top portion, a bottom portion, and a pair of generally diametrically spaced throats connecting the top portion and the bottom portion, the bottom portion having a longer axial length than the top portion, the throats defining first and second openings generally diametrically spaced from each other between the top portion and the bottom portion, each opening comprising a substantially cylindrical cutout having a longitudinal axis substantially perpendicular to but not intersecting with the longitudinal axis of the cylindrical body the cutout being defined by flat, outwardly facing concave walls;

wherein an inside surface and an outside surface of the bottom portion define a bottom portion thickness, and wherein an inside surface and an outside surface of each of the throats defines a throat thickness, such that the bottom portion thickness is the same as the throat thickness.

17. The golf tee setting device according to claim 16, wherein the body includes indicia related to the length of the body.

18. The golf tee setting device according to claim 16, wherein first and second openings are each defined by a wall having a top portion and a bottom portion, each of the top and bottom portions obliquely sloping inwardly toward the longitudinal axis.

19. The golf tee setting device according to claim 16, wherein the first and second openings have a coincident opening axis extending perpendicular to the longitudinal axis.

20. The golf tee setting device according to claim 16, wherein the body further comprises gripping lip disposed proximate to a top portion of the body and wherein the pair of throats connect the gripping lip with the remainder of the body on either side of the first and second openings.

21. The golf tee setting device according to claim 16, wherein the body has a length sufficient to insert a golf tee at least partially disposed therein into the ground such that the golf tee extends from the ground a desired distance.

* * * * *